US009183707B2

(12) United States Patent
Cuddy et al.

(10) Patent No.: US 9,183,707 B2
(45) Date of Patent: Nov. 10, 2015

(54) SYSTEM AND METHOD FOR PROVIDING A GAME WITH DYNAMIC SYMBOL STACKING

(71) Applicant: Video Gaming Technologies, Inc., Franklin, TN (US)

(72) Inventors: Ryan Cuddy, Franklin, TN (US); Lyndsay Nelson, Franklin, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 0 days.

(21) Appl. No.: 13/631,950

(22) Filed: Sep. 29, 2012

(65) Prior Publication Data

US 2014/0094269 A1 Apr. 3, 2014

(51) Int. Cl.

| | |
|---|---|
| ***G07F 17/00*** | (2006.01) |
| ***G07F 19/00*** | (2006.01) |
| ***G07F 17/34*** | (2006.01) |
| ***G07F 17/32*** | (2006.01) |

(52) U.S. Cl.
CPC ..... *G07F 17/34* (2013.01); *G07F 17/3267* (2013.01)

(58) Field of Classification Search
CPC ... G07F 17/32; G07F 17/3244; G07F 17/326; G07F 17/3267; G07F 17/34
USPC ..... 463/16–20, 25, 29–31
See application file for complete search history.

(56) References Cited

U.S. PATENT DOCUMENTS

| | | | | |
|---|---|---|---|---|
| 6,394,902 | B1 | 5/2002 | Glavich et al. | |
| 6,413,162 | B1 | 7/2002 | Baerlocher et al. | |
| 6,485,367 | B1 * | 11/2002 | Joshi | 463/13 |
| 6,641,477 | B1 | 11/2003 | Dietz, II | |
| 6,695,696 | B1 * | 2/2004 | Kaminkow | 463/16 |
| 6,921,335 | B2 | 7/2005 | Rodgers et al. | |
| 7,074,127 | B2 | 7/2006 | Cuddy et al. | |
| 7,252,589 | B1 * | 8/2007 | Marks et al. | 463/16 |
| 7,553,231 | B2 | 6/2009 | Rodgers et al. | |
| 7,591,724 | B2 | 9/2009 | Baerlocher | |
| 7,914,376 | B2 | 3/2011 | Walker et al. | |
| 8,096,869 | B2 | 1/2012 | Yoshimi | |
| 8,574,060 | B2 | 11/2013 | Nakamura et al. | |
| 8,727,872 | B2 | 5/2014 | Hoffman et al. | |
| 2003/0224849 | A1 * | 12/2003 | Geiger | 463/20 |
| 2004/0072612 | A1 * | 4/2004 | Rodgers et al. | 463/20 |
| 2004/0137982 | A1 * | 7/2004 | Cuddy et al. | 463/20 |
| 2005/0070354 | A1 * | 3/2005 | Baerlocher et al. | 463/20 |
| 2006/0160595 | A1 * | 7/2006 | Gerson et al. | 463/16 |
| 2006/0183534 | A1 * | 8/2006 | Yoshimi | 463/20 |
| 2006/0264254 | A1 * | 11/2006 | Aoki | 463/20 |
| 2006/0281525 | A1 * | 12/2006 | Borissov | 463/20 |
| 2008/0234033 | A1 * | 9/2008 | Berman et al. | 463/20 |
| 2008/0318660 | A1 * | 12/2008 | Nores | 463/20 |
| 2012/0064961 | A1 * | 3/2012 | Vancura | 463/20 |
| 2012/0295688 | A1 * | 11/2012 | Watkins et al. | 463/20 |

OTHER PUBLICATIONS

PCT Search Report and Written Opinion for related matter PCT/US2014/056213 dated Dec. 31, 2014; 12 pp.

* cited by examiner

*Primary Examiner* — Milap Shah
(74) *Attorney, Agent, or Firm* — Armstrong Teasdale LLP

(57) ABSTRACT

A gaming machine that includes a game of chance operable upon a wager by a player, a display, and a plurality of reels associated with the game of chance, wherein each of the plurality of reels include a defined plurality of positions to generate a symbol on the display. The gaming machine further including a processor programmed to provide the game of chance on the gaming machine, determine that at least two symbols generated on one of the plurality of reels are a designated symbol, and based on the determining, lock a position of the one of the plurality of reels for at least one additional generation of symbols on the other of the plurality of reels.

28 Claims, 7 Drawing Sheets

SYSTEM AND METHOD FOR PROVIDING A GAME WITH DYNAMIC SYMBOL STACKING

BACKGROUND

The embodiments described herein relate generally to gaming systems and methods that provide games of chance and, more particularly, to systems and methods for providing a game of chance with dynamic symbol stacking.

Conventionally, gaming machines provide games wherein a player has one or more opportunities to obtain a winning symbol combination on mechanical or video reels. The winning symbol combination may be along the same payline or on different paylines (known as a scatter pay). By providing gaming devices with more winning symbol combinations, players have more opportunities to receive an award. However, the probability of obtaining the largest award (i.e., the jackpot award) is typically much lower than the probability of obtaining the other awards in a game. Thus, although a player may obtain more awards in a game, these awards are generally relatively small awards and not relatively large awards such as the jackpot award.

Gaming machines that increase the probability of obtaining the relatively large award and specifically, the jackpot award, are desirable. To increase player enjoyment and excitement, it is desirable to provide new games and gaming devices which increase the likelihood or probability that the player will obtain one or more relatively large awards in a game.

BRIEF DESCRIPTION

In one aspect, a gaming machine is provided. The gaming machine includes a game of chance operable upon a wager by a player, a display, a plurality of reels associated with the game of chance, wherein each of the plurality of reels include a defined plurality of positions to generate a symbol on the display, and a processor. The processor is programmed to provide the game of chance on the gaming machine, determine that at least two symbols generated on one of the plurality of reels are a designated symbol, and based on the determining, lock a position of the one of the plurality of reels for at least one additional generation of symbols on the other of the plurality of reels.

In another aspect, a method for playing a game of chance on a gaming machine is provided, wherein the gaming machine includes a plurality of reels associated with the game of chance, and wherein each of the plurality of reels include a defined plurality of positions to generate a symbol. The method includes providing the game of chance on the gaming machine, determining that at least two symbols generated on one of the plurality of reels are a designate symbol, and based on the determining, locking a position of the one of the plurality of reels for at least one additional generation of symbols on the other of the plurality of reels.

In yet another aspect, a gaming system is provided. The gaming system includes a gaming machine that includes a display, and a plurality of reels associated with a game of chance, wherein each of the plurality of reels includes a defined plurality of positions to generate a symbol on the display. The system further including a server that includes a processor, wherein the processor is programmed to provide the game of chance to a player operating the gaming machine, initiate the game of chance on the gaming machine upon receiving a wager from the player, determine that at least two symbols generated on one of the plurality of reels are a designated symbol, and based on the determining, lock a position of the one of the plurality of reels for at least one additional generation of symbols on the other of the plurality of reels.

In yet another aspect, a gaming machine is provided. The gaming machine including a game of chance operable upon a wager by a player, a plurality of reels associated with the game of chance, each of the plurality reels including a plurality of defined symbol positions, a first set of the plurality of defined symbol positions is configured to be populated with a plurality of determinate symbols, a second set of the plurality of defined symbol positions is configured to be populated with one or more indeterminate symbols, and a display including a pre-defined plurality of positions to present a symbol thereon for each of the plurality of reels, and a processor. The processor is programmed to provide the game of chance on the gaming machine, populate the first set of the plurality of defined symbol positions on each of the plurality of reels with the plurality of determinate symbols, select a designated symbol to populate the second set of the plurality of defined symbol positions on each of the plurality of reels, populate the second set of the plurality of defined symbol positions on each of the plurality of reels with the designated symbol, determine that at least two symbols generated on one of the plurality of reels and presented on the display are the designated symbol, and based on the determining, lock a position of the one of the plurality of reels for at least one additional generation of symbols on the other of the plurality of reels.

In yet another aspect, a method for playing a game of chance on a gaming machine that includes a display and a plurality of reels associated with the game of chance, each of the plurality reels including a plurality of defined symbol positions, a first set of the plurality of defined symbol positions is configured to be populated with a plurality of determinate symbols, and a second set of the plurality of defined symbol positions is configured to be populated with one or more indeterminate symbols. The method includes providing the game of chance on the gaming machine, populating the first set of the plurality of defined symbol positions one each of the plurality of reels with the plurality of determinate symbols, selecting a designated symbol to populate the second set of the plurality of defined symbol positions on each of the plurality of reels, populating the second set of the plurality of defined symbol positions on each of the plurality of reels with the designated symbol, determining that at least two symbols generated on one of the plurality of reels and presented on the display are the designated symbol, and based on the determining, locking a position of the one of the plurality of reels for at least one additional generation of symbols on the other of the plurality of reels.

In yet another aspect, a gaming system that includes a gaming machine and a server with a processor is provided. The gaming machined includes a plurality of reels associated with the game of chance, each of the plurality reels including a plurality of defined symbol positions, a first set of the plurality of defined symbol positions is configured to be populated with a plurality of determinate symbols, and a second set of the plurality of defined symbol positions is configured to be populated with one or more indeterminate symbols. The display includes a pre-defined plurality of positions to present a symbol thereon for each of the plurality of reels. The server includes the processor that is programmed to provide the game of chance on the gaming machine, populate the first set of the plurality of defined symbol positions one each of the plurality of reels with the plurality of determinate symbols, providing a designated symbol to populate the second set of the plurality of defined symbol positions on each of the plurality of reels, populate the second set of the plurality of defined symbol positions on each of the plurality of reels with the designated symbol, determine that at least two symbols generated on one of the plurality of reels and presented on the display are the designated symbol, and based on the determining, lock a position of the one of the plurality of reels for at least one additional generation of symbols on the other of the plurality of reels.

BRIEF DESCRIPTION OF THE DRAWINGS

The embodiments described herein may be better understood by referring to the following description in conjunction with the accompanying drawings.

DETAILED DESCRIPTION

The embodiments described herein relate generally to gaming systems and methods that provide games of chance to a player operating a gaming machine and, more particularly, to systems and methods for providing a game of chance with dynamic symbol stacking.

Exemplary technical effects of the systems, methods, and apparatus described herein include at least one of: (a) providing the game of chance on the gaming machine; (b) determining that at least two symbols generated on one of the plurality of reels are a designated symbol; and (c) based on the determining, locking a position of the one of the plurality of reels for at least one additional generation of symbols on the other of the plurality of reels.

Figure 1:
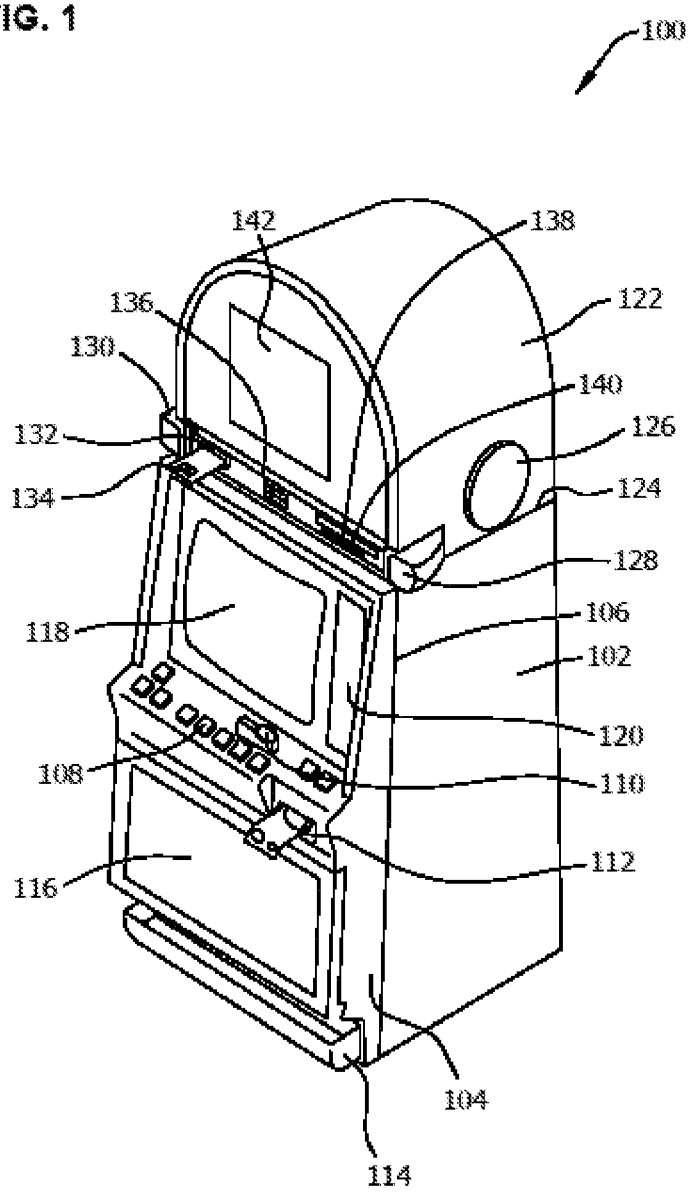
FIG. 1 is a schematic diagram of an exemplary gaming machine.

FIG. 1 is a schematic diagram of an exemplary gaming machine 100 that enables play of a base game and one or more bonus features, if applicable. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a main cabinet 102 having a main door 104 coupled to a front 106 of gaming machine 100. When opened, door 104 provides access to an interior (not shown) of gaming machine 100. In the exemplary embodiment, a plurality of player-input switches and/or buttons 108 is coupled to main door 104. Moreover, in the exemplary embodiment, a coin acceptor 110, for accepting coins and/or tokens, a bill acceptor 112, for accepting and/or validating cash bills, coupons and/or ticket vouchers, a coin tray 114, for collecting a coin-based payout, and a belly glass 116 are each coupled to main door 104. A primary display device 118 and an information panel 120 are viewable through main door 104. In one embodiment, primary display device 118 displays a plurality of reels, such as three to five reels in mechanical or video form. If the reels are in video form, primary display device 118 may be a video monitor. In one embodiment, each reel of the plurality of reels displays a plurality of indicia such as bells, hearts, fruits, numbers, letters, bars or other images which preferably correspond to a theme associated with gaming machine 100.

Primary display device 118 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, primary display device 118 may include touch screen capabilities. In the exemplary embodiment, information panel 120 is a back-lit, silk screened glass panel that includes lettering to indicate general game information including, for example, a number of coins wagered. Coin acceptor 110, bill acceptor 112, player-input buttons 108, primary display device 118, and information panel 120 are each used by a player to play a game on gaming machine 100. Each component 108, 110, 112, 118, and/or 120 is controlled by a gaming machine controller (not shown in FIG. 1) that is housed inside main cabinet 102. Numerous games including, but not limited to only including, video slot games, video poker, video pachinko, video black jack, video card games, and/or video keno may be implemented for play on gaming machine 100.

In the exemplary embodiment, gaming machine 100 also includes a top box 122 that is positioned on a top surface 124 of main cabinet 102. In the exemplary embodiment, top box 122 includes a number of devices that may be used to add features to a game being played on gaming machine 100. Such devices may include, but are not limited to only including, speakers 126, 128, and 130, a ticket printer 132 for printing bar-coded tickets 134, a key pad 136 for entering player tracking information, or player preferences or characteristics, a display 138 for displaying player tracking information and/or player preferences or characteristics, and a card reader 140 for receiving a card containing player tracking information and/or player preferences or characteristics encoded thereon. Card reader 140 may also be used to accept credit cards, printed cards, smart cards, and/or other magnetic stripe cards. Moreover, top box 122 includes a secondary display device 142 that displays, for example, player information, an attract sequence, a bonus game, or any other suitable images. Secondary display device 142 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, secondary display device 142 may include touch screen capabilities. Top box 122 may house additional devices not shown in FIG. 1, such as, for example, a bonus wheel and/or a back-lit silk screened panel that may be used to add bonus features to a game being played on gaming machine 100. During play of a base game, such devices may be controlled by circuitry, such as the gaming machine controller housed within main cabinet 102. During play of a bonus game, such devices may be controlled by circuitry, such as a bonus controller (not shown in FIG. 1) as described in detail below.

Figure 2:
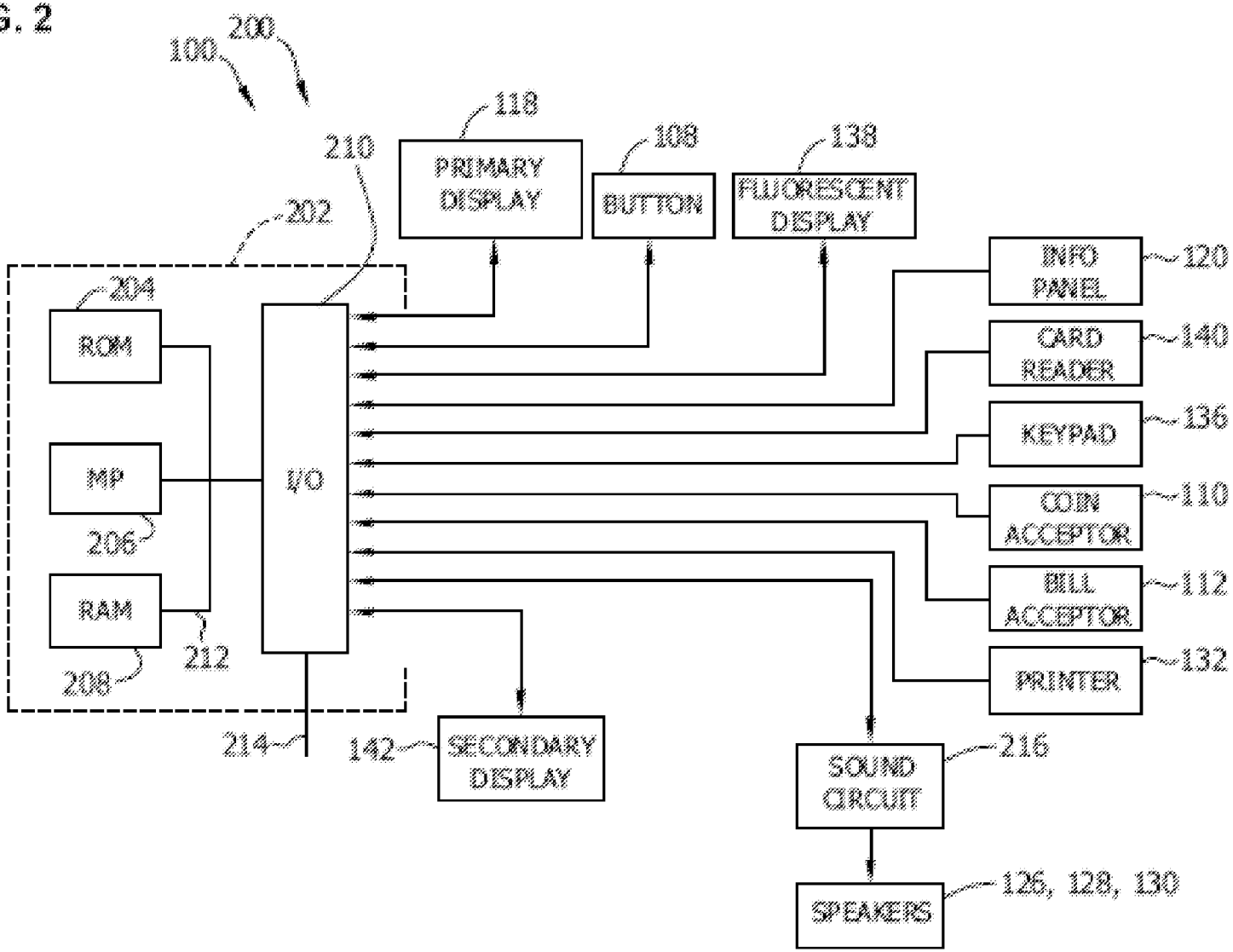
FIG. 2 is a block circuit diagram of an exemplary electrical architecture that may be used with the gaming machine shown in FIG. 1.

FIG. 2 is a block circuit diagram of an exemplary electrical architecture 200 incorporated into an exemplary gaming machine, such as gaming machine 100. In the exemplary embodiment, gaming machine 100 includes a gaming machine controller 202 that includes a read-only memory (ROM) 204, a microcontroller or microprocessor (MP) 206, a random-access memory (RAM) 208, and an input/output (I/O) circuit 210, each coupled via an address/data bus 212.

As used herein, the terms "controller" and "processor" may include any programmable system including systems using microcontrollers, reduced instruction set circuits (RISC), application specific integrated circuits (ASICs), logic circuits, and any other circuit or processor capable of executing the functions described herein. The above examples are exemplary only, and are thus not intended to limit in any way the definition and/or meaning of the terms "controller" or "processor". Alternative embodiments of controller 202 may include more than one microprocessor 206, multiple RAM modules 208, and/or multiple ROM modules 204. Moreover, although I/O circuit 210 is shown in FIG. 2 as a single component, one of ordinary skill in the art will appreciate that I/O circuit 210 may include any number or a plurality of different types of I/O circuits. Further, RAM 208 and/or ROM 204 may be implemented as, for example, semiconductor memories, magnetically readable memories, and/or optically readable memories. In one embodiment, each operational component of gaming machine 100 is coupled to I/O circuit 210 via a respective conductor and/or via bus 212. Alternative embodiments may include a single coupling between the operational components of gaming machine 100 and I/O circuit 210. In the exemplary embodiment, I/O circuit 210 is coupled to a gaming network (not shown) via a network interface 214. Moreover, in the exemplary embodiment, architecture 200 includes a sound circuit 216 that generates audio signals and that communicates the audio signals between I/O circuit 210 and speakers 126, 128, and/or 130.

Figure 3:
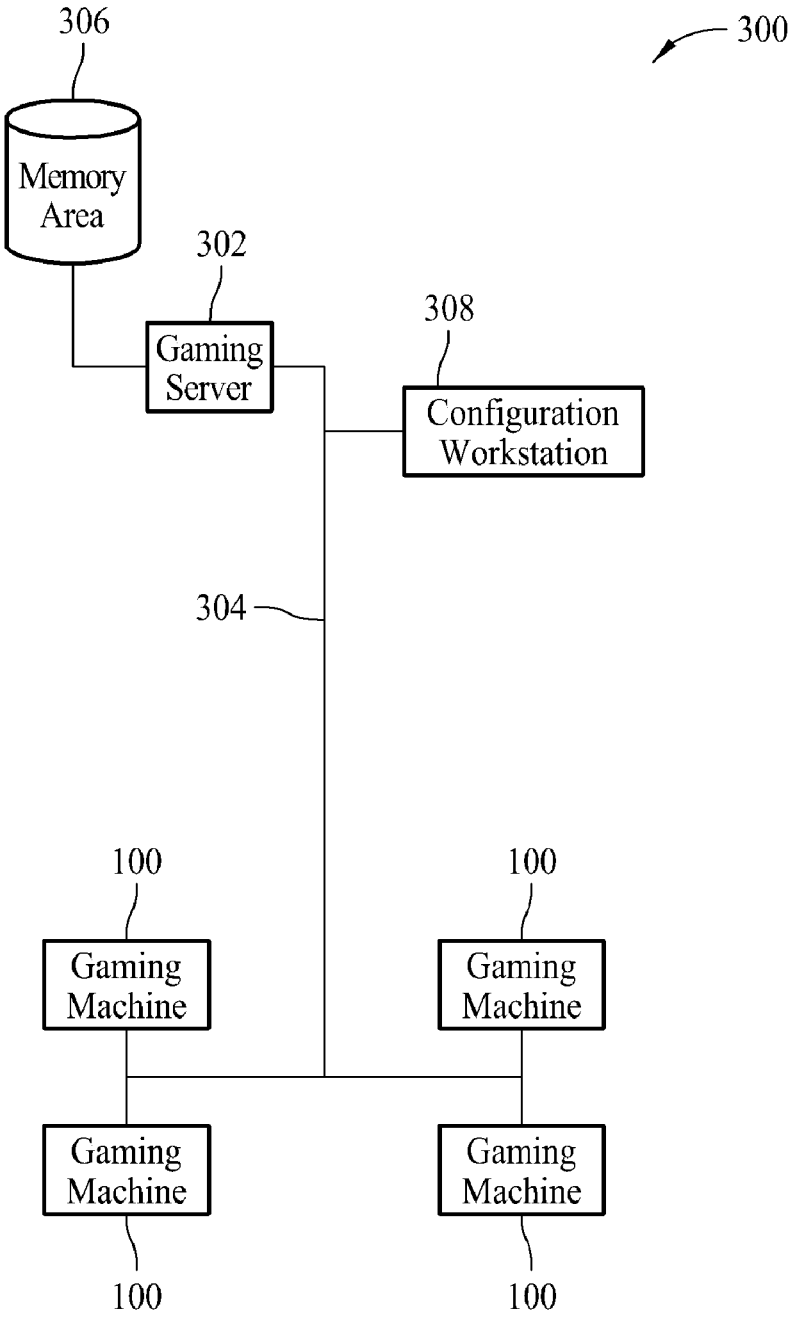
FIG. 3 is a block schematic diagram of an exemplary gaming system that includes a plurality of gaming machines shown in FIG. 1.

FIG. 3 is a block schematic diagram of an exemplary gaming system 300 that includes a plurality of gaming machines 100. Each gaming machine 100 is coupled to one or more servers, such as a gaming server 302, using a network 304. Gaming server 302 includes a processor (not shown) that facilitates data communication between each gaming machine 100 and other components of gaming system 300. Such data is stored in, for example, a memory area 306, such as a database, that is coupled to gaming server 302.

In one embodiment, one or more gaming machines 100 may be remote gaming machines that access a casino over network 304. As such, a player is able to participate in a game of chance on a remote gaming machine. In this embodiment, it will be understood that a player operating a remote gaming machine has virtual access to any casino coupled to network 304 and associated with gaming server 302. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance, remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 302. In such an embodiment, gaming machines 100 display results of a game via primary display device 118 and secondary display device 142 (shown in FIGS. 1 and 2).

In one embodiment, gaming server 302 performs a plurality of functions including, for example, game outcome generation, executing a game play event for a player, player tracking functions, and/or accounting functions, to name a few. However, in alternative embodiments, gaming system 300 may include a plurality of servers that separately perform these functions and/or any suitable function for use in a network-based gaming system.

For example, gaming server 302 may provide a game of chance (e.g., a video slot game) to a player operating one of gaming machines 100. That is, server 302 may display a plurality of reels to a player on primary display device 118. To initiate the video slot game, the player must insert an appropriate amount of money or tokens at coin acceptor 110 or bill acceptor 112 and then push a play button (for example, one of player input buttons 108. When the wager is received, server 302 enables the reels shown on primary display device 118 to spin. Eventually, the reels will come to a stop and depending upon where the reels stop, server 302 determines whether the player wins an award and/or additional credits.

As mentioned above, embodiments of the present disclosure enable players an opportunity to win rewards/credits by dynamically stacking designated symbols (described in further detail below) during a primary game or in a bonus round. Server 302 may initiate this stacking feature when the player has achieved a qualifying condition in the game. In one embodiment, this qualifying condition is a particular arrangement of designated symbols on primary display device 118, as shown in FIG. 4.

Figure 4:
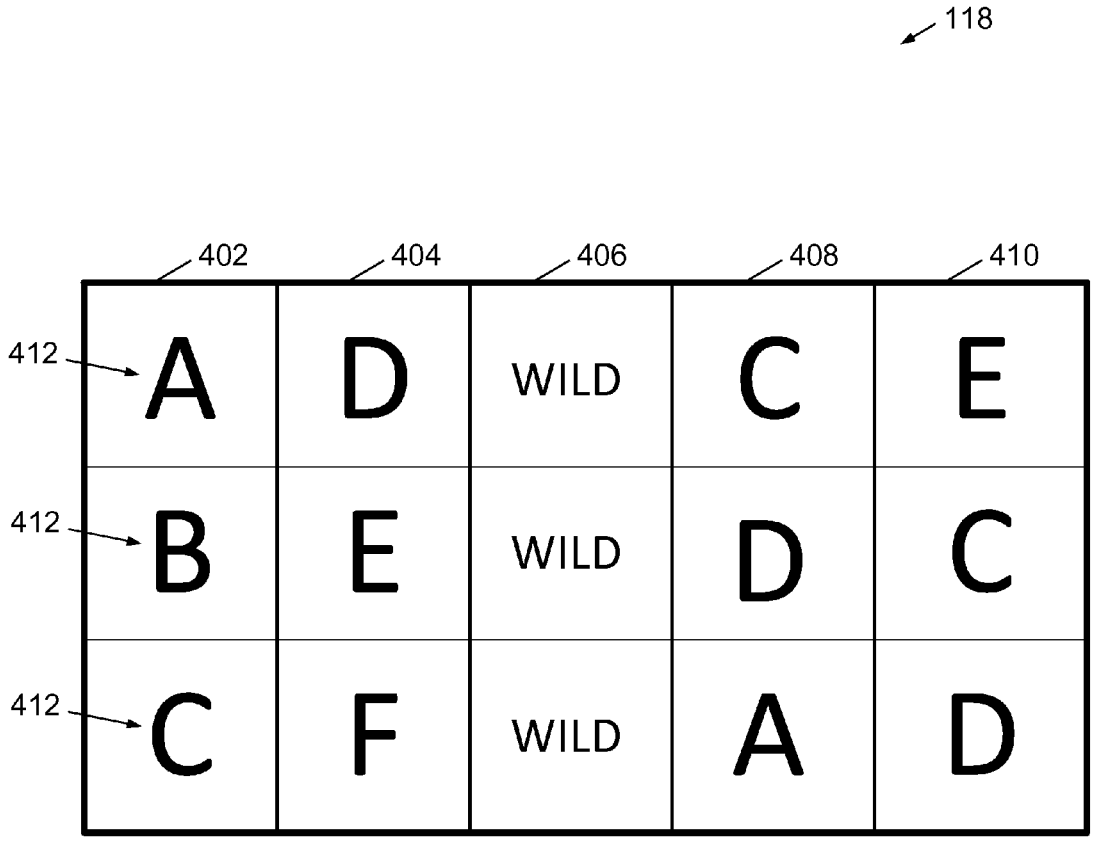
FIGS. 4 and 5 are screen views of an exemplary video slot game that may be used with the gaming machine shown in FIG. 1.

For example, in FIG. 4, a screen view of an exemplary game of chance provided on primary display 118 is shown. Five reels (not shown) represented by columns 402, 404, 406, 408, and 410, respectively, have generated and displayed three symbols 412 each. In this example, a qualifying condition is when each symbol generated and presented in a column is a designated symbol. For example, in FIG. 4, the "wild" symbol is the designated symbol and a third reel (represented by column 406) has generated and presented three "wild" symbols. Thus, as three "wild" symbols have been generated and presented in column 406, server 302 determines that the qualifying condition has been met.

As a result of determining that the qualifying condition has been met, server 302 fixes, locks, or holds stationary the third reel and enables a player to execute a first free "spin" (e.g., a spin/generation of symbols without an additional wager) of a first reel (represented by column 402), a second reel (represented by column 404), a fourth reel (represented by column 406), and a fifth reel (represented by column 410). That is, server 302 enables four of the five reels to remain active while one (e.g., the third reel) is locked in place. After the first free spin, server 302 determines if any of the four active reels generate and present the "wild" symbol. If none of the four active reels generate and present a "wild" symbol, the game may be terminated and an additional wager is needed to initiate a new game. If, however, a "wild" symbol is generated and presented on one of the four active reels, the position displaying the "wild" symbol on the reel is locked and server 302 enables the player to execute a second free spin on the four active reels again. In one embodiment, if a "wild" symbol is generated and presented on one of the four active reels, the entire reel that generated the "wild" symbol is locked and server 302 enables the player to execute a second free spin of the remaining reels. For example, with reference to FIG. 5, the first reel (represented by column 402) is locked and either the entire third reel (represented by column 406) is locked or only the positions displaying the "wild" is locked enabling the remaining positions on the third reel and the second reel (represented by column 404), the fourth reel (represented by column 408), and the fifth reel (represented by column 410) to be spun for a third time. Server 302 may enable this process to continue until either server 302 determines that, for example, each reel has generated a wild symbol or when server 302 determines that an additional spin does not result in a generation of a "wild" symbol.

Figure 5:
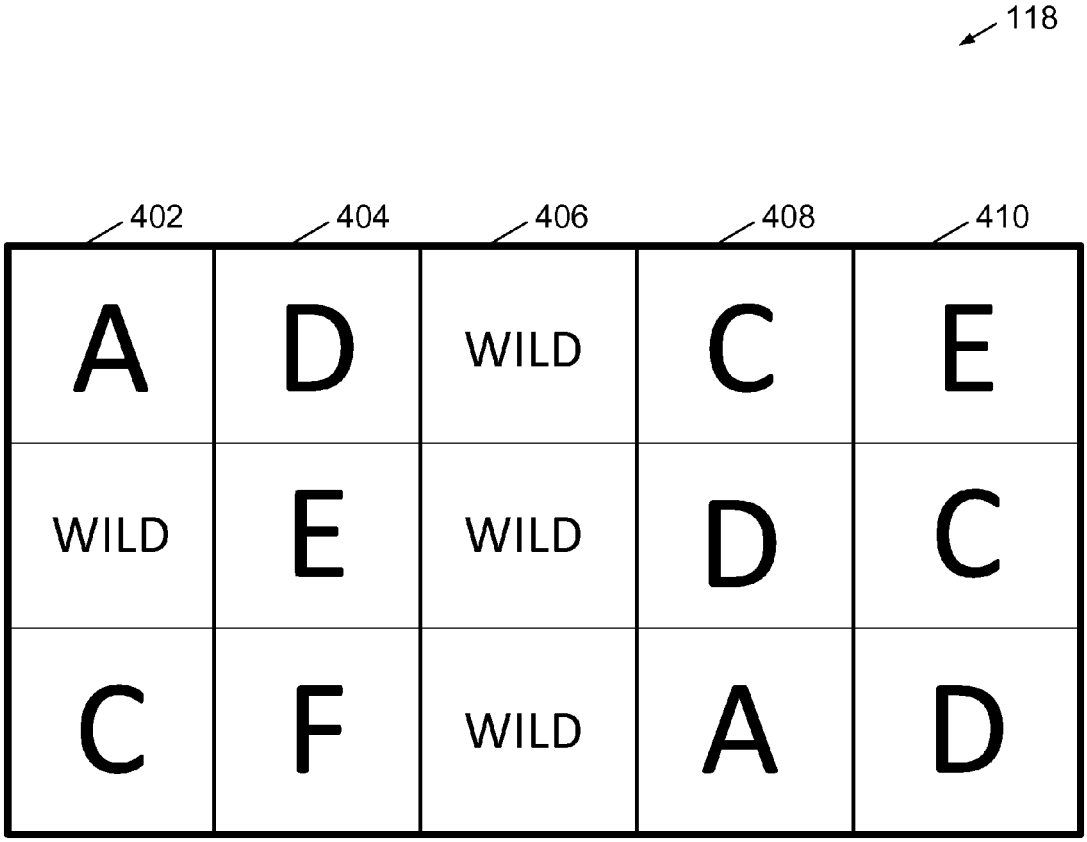
Figure 6:
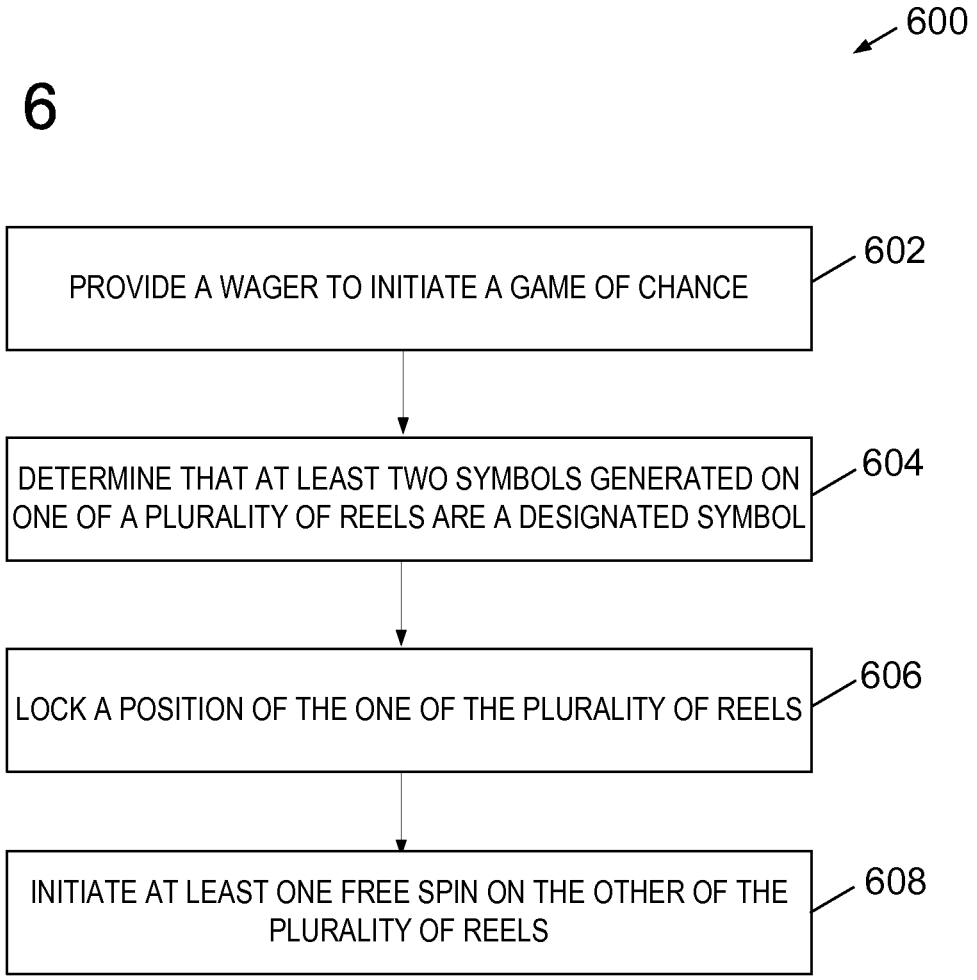
FIG. 6 is a flowchart that illustrates an exemplary method for providing a game of chance on the gaming machine shown in FIG. 1.

With reference now to FIG. 6, an exemplary method 600 for providing a game of chance on gaming machine 100 is provided. At 602, a player provides a wager to initiate a game of chance (e.g., a video slot game) on gaming machine 100. In one embodiment, a plurality of reels (e.g., three to five reels) associated with the game of chance are displayed on primary display device 118, and each of the plurality of reels include a defined plurality of positions to generate and display a symbol on primary display device 118. For example, if five reels are used in a video slot game and each reel is enabled to generate and display three symbols on primary display device 118, then primary display device 118 provides five columns of symbols, with three symbols in each column (as shown in FIGS. 4 and 5). In one embodiment, each reel includes a plurality of symbols (e.g., determinate symbols) that may be generated and displayed. Further, within the plurality of symbols that may be generated and displayed is a plurality of designated symbols (e.g., indeterminate symbols).

In one embodiment, a qualifying condition is met when two or more positions in a column generate and display a designated symbol (e.g., as shown in FIG. 4). For example, upon an initiation of the video slot game, each of the plurality of reels are spun and, at 604, it is determined that at least two symbols generated on one of the plurality of reels and displayed is a designated symbol (e.g., a "wild" symbol). In one embodiment, the qualifying condition may require each of the designated symbols to be generated and displayed in consecutive order. Further, the qualifying condition may require each position in an entire column to generate and display the designated symbol (e.g., as shown in FIG. 4). Based on the determination that at least two symbols generated on one of the plurality of reels and displayed are the designated symbol, at 606, a position of the one of the plurality of reels is locked, and at 608, the player is enabled to initiate at least one free "spin" on the other of the plurality of reels (e.g., the active reels). That is, the real that generates and displays two or more of the designated symbol is fixed, locked, or held stationary while the other reels are enabled to be spun again without requiring an additional wager.

In one embodiment, after a first free spin of the active reels, if none of the active reels generate and display the designated symbol, the game may be terminated, an award (if applicable) may be provided for the displayed symbols. However, in one embodiment, a predefined number of free spins may be provided such that if none of the active reels generate and display the designated symbol, the player may keep "spinning" the active reels up to the predefined number of free spins. Thus, if after the predefined number of free spines is used and none of the active reels have generated and displayed a designated symbol, the game is terminated, and if applicable, an award is provided based on the final displayed symbols. If, however, on any one of the predefined number of free spins a designated symbol is generated and displayed on one of the active reels, each position on each reel that generates and displays the designated symbol is locked and the player is enabled to "spin" the remaining positions of the active reels again (as shown in FIG. 5). In one embodiment, this process may continue until either it is determined that each reel has generated and displayed a designated symbol, or until it is determined that the predefined number of free "spins" is exhausted and none of the remaining active reels generated the designated symbol.

In one embodiment, each time a designated symbol is generated and displayed on any of the plurality of reels, a copy of the designated symbol is presented on secondary display device 142. As such, secondary display device 142 provides the player with the number of designated symbols accumulated during play of the video slot game. In one embodiment, a reward may be provided to the player once a predefined number of the designated symbol is accumulated on secondary display device 142. In another embodiment, a video slot bonus game may be initiated when a predefined number of the designated symbol is accumulated on secondary display device 142. Thus, the method of FIG. 6 may be repeated as the video slot bonus game.

Figure 7:
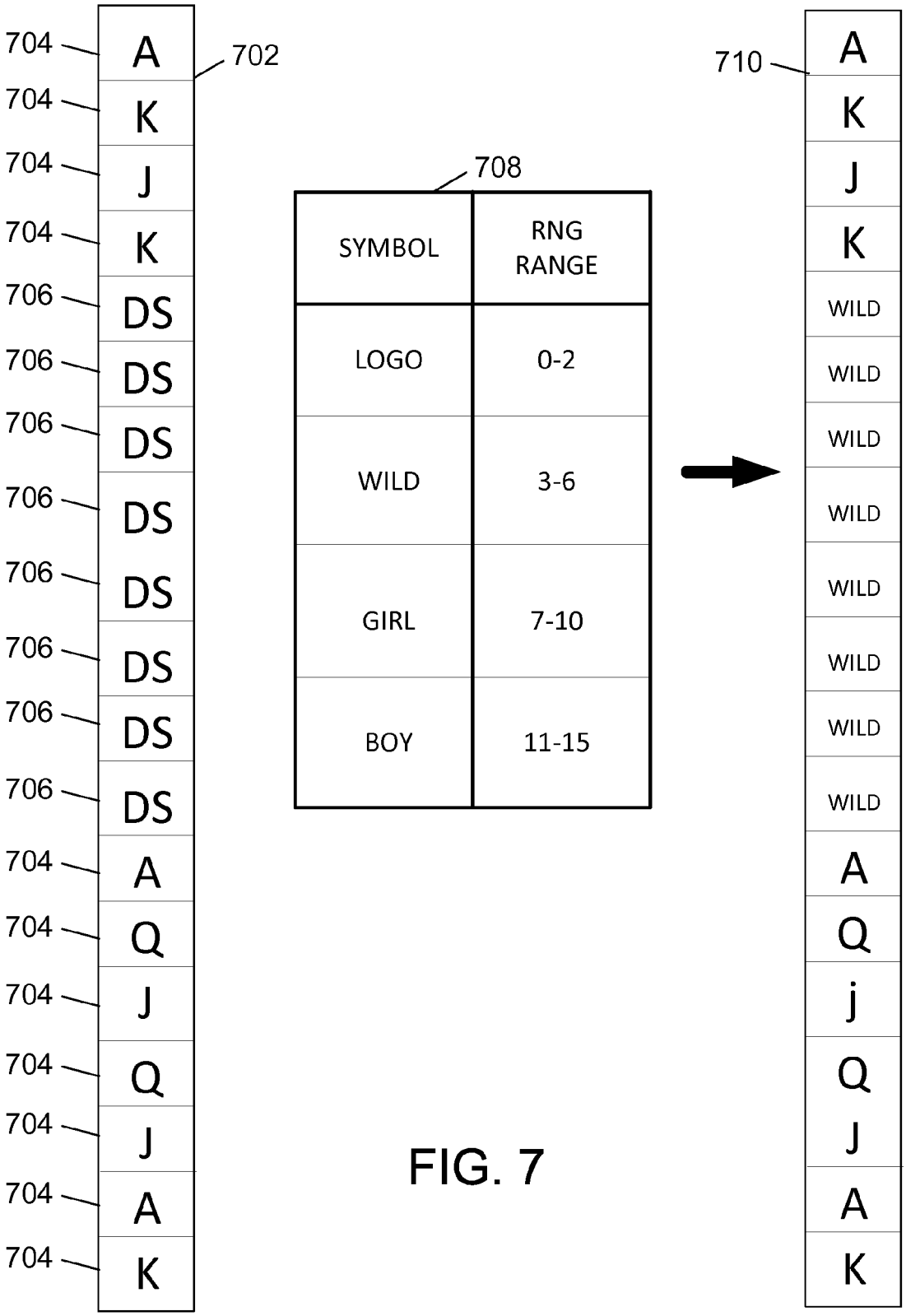
FIG. 7 is a block diagram illustrating a process for augmenting a reel in a game of chance provided on the gaming machine shown in FIG. 1.

With reference now to FIG. 7, a process for augmenting reels in a game of chance provided. For example, as shown in FIG. 7, reel 702 includes a plurality of defined symbol positions. A first set 704 of the plurality of defined symbol positions are configured to be populated with a plurality of determinate symbols. A second set 706 of the plurality of defined symbol positions are configured to be populated with an indeterminate symbol, such as a designated symbol. Upon initiation of the game of chance, first set 702 of the plurality of defined symbol positions on each of the plurality of reels are populated with determinate symbols (FIG. 7 showing an example of one reel 702 being populated with determinate symbols "A", "K", "J" . . . ), and a designated symbol is selected to populate second set 706 of the plurality of defined symbol positions on each of the plurality of reels. In one embodiment, a player is enabled to select a designated symbol. For example, the player may be enabled to select one of the determinate symbols in the game, a lucky number, or from a set of designated symbols provided to the player. In another embodiment, a random number generator (RNG) may use a weighted table 708 of designated symbols to determine which of the designated symbols to include in second set 706 of the plurality of defined symbol positions. Thus, after the RNG produces a particular number (e.g., "4"), that number is associated with a designated symbol in weighted table 708 and the associated designated symbol is included into second set 706 of the plurality of defined symbol positions. For example, augmented reel strip 710 includes designated symbol "wild" in each of the plurality of defined symbol positions in second set 706.

In one embodiment, not all of the reels in the video slot base game are augmented. For example, in a video slot base game that utilized five reels, each of the three middle reels may be augmented leaving the outside reels not augmented. In this example, only the three middle reels are used in the video slot bonus game. That is, non-augmented reels are not used in the video bonus game. However, once the reels selected to be augmented are augmented, the video slot game is initiated, each augmented real is "spun", and steps 604-608 described above with reference to FIG. 6 are executed.

In a further embodiment, second set 706 of the plurality of defined symbol positions may be populated with a plurality of designated symbols. In this example, after one of the plurality of reels (e.g., a first reel) generates and displays two or more of one of the designated symbols, that reel is locked. However, prior to "spinning" the remaining active reels, second set 706 of the plurality of defined symbol positions in each of the remaining active reels are changed to be populated with the designated symbol that was generated and displayed on the first reel. Thus, instead of second set 706 of the plurality of defined symbol positions on the remaining active reels still being populated with a plurality of designated symbols, they are now populated with the designated symbol that was generated and displayed on the first reel. This gives the player a better chance of matching the designated symbol. As such, second set 706 of the plurality of defined symbol positions can be populated with one or more designated symbols at a beginning of a game, and thereafter, be repopulated with a different designated symbol, or symbols during the game.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A game machine comprising:

a display device configured to display a plurality of symbol positions representing a plurality of reels, each symbol position presenting a symbol thereon for play of a wagering game;

a random number generator;

an accepting device configured to accept an item associated with a monetary value, the monetary value establishing a credit balance, the credit balance being increasable and decreasable based at least on wagering activity;

a cashout device configured to receive an input to cause an initiation of a payout associated with the credit balance;

a non-transitory memory device storing computer-executable instructions thereon; and a processor coupled to the non-transitory memory device and configured to execute the computer-executable instructions to:

receive a wager amount placed for play of the wagering game, the wager amount decreasing the credit balance, the wagering game including the plurality of reels;

populate a first set of the plurality of symbol positions on each of the plurality of reels with a plurality of predetermined symbols;

select a designated symbol;

populate a second set of the plurality of symbol positions on each of the plurality of reels with the designated symbol;

simulate and display a first spin of the plurality of reels using the random number generator and the display device;

identify, after the first spin, that a first reel of the plurality of reels displays at least two of the designated symbols;

lock at least one symbol position of the first reel for at least a second spin of remaining reels of the plurality of reels only when the first reel displays the at least two of the designated symbols; and detect the input to cause the initiation of the payout, via the cashout device.

2. A game machine in accordance with claim 1, wherein the designated symbol is selected from a plurality of designated symbols.

3. A game machine in accordance with claim 2, wherein each of the plurality of designated symbols have different weighted values.

4. A game machine in accordance with claim 1, wherein the at least the second spin of the remaining reels is without an additional wager.

5. A game machine in accordance with claim 1, wherein the at least two of the designated symbols are populated in consecutive order on at least one of the plurality of reels.

6. A game machine in accordance with claim 1, wherein the processor is further programmed to:

after the second spin, determine that at least a second reel displays at least one of the designated symbols; and lock at least one position of at least the second reel for a further spin of the remaining reels.

7. A game machine in accordance with claim 1, wherein the processor is further programmed to:

determine that a pre-defined number of the designated symbol is displayed on any of the other of the plurality of reels after at least the second spin; and award a prize based at least in part on the determining.

8. A game machine in accordance with claim 7, further comprising an additional display; and wherein the processor is further programmed to take a copy of each designated symbol that is presented on the display and present the copy on the additional display.

9. A game machine in accordance with claim 8, wherein the additional display includes a number of symbol positions equal to the number of symbol positions on the display.

10. A game machine in accordance with claim 1, wherein the processor is further programmed to:

determine that less than a pre-defined number of the designated symbols is displayed on all of the other of the plurality of reels after at least the second spin; and terminate any further generations of symbols on the plurality of reels, based at least in part on the determining, until an additional wager is made.

11. A method for playing a wagering game on a gaming machine including a display device, a random number generator, an accepting device configured to accept an item associated with a monetary value, the monetary value establishing a credit balance, the credit balance being increasable and decreasable based at least on wagering activity, a cashout device configured to receive an input to cause an initiation of a payout associated with the credit balance, a non-transitory memory device storing computer-executable instructions thereon, and a processor coupled to the non-transitory memory device, the method comprising the steps of:

receiving, by the processor, a wager amount placed for play of the wagering game, the wager amount decreasing the credit balance, the wagering game including the plurality of reels;

displaying, by the display device, a plurality of symbol positions representing a plurality of reels, each symbol position presenting a symbol thereon for play of the wagering game;

populating, by the processor, a first set of the plurality of symbol positions on each of the plurality of reels with a plurality of pre-determined symbols;

selecting, by the processor, a designated symbol;

populating, by the processor, a second set of the plurality of symbol positions on each of the plurality of reels with the designated symbol;

simulating and displaying a first spin of the plurality of reels using the random number generator and the display device;

identifying, by the processor and after the first spin, that a first reel of the plurality of reels displays at least two of the designated symbols;

locking, by the processor, at least one symbol position of the first reel for at least a second spin of remaining reels of the plurality of reels only when the first reel displays the at least two of the designated symbols; and detecting the input to cause the initiation of the payout, via the cashout device.

12. A method in accordance with claim 11, wherein the designated symbol is selected from a plurality of designated symbols.

13. A method in accordance with claim 12, wherein each of the plurality of designated symbols have different weighted values.

14. A method in accordance with claim 11, wherein at least the second spin of the remaining reels is performed without an additional wager.

15. A method in accordance with claim 11, wherein identifying, after the first spin, that the first reel displays at least two of the designated symbols further includes determining that at least two of the designated symbols are populated in consecutive order on at least one of the plurality of reels.

16. A method in accordance with claim 11, further comprising:

after the second spin, determining that at least a second reel displays at least one of the designated symbols; and locking at least one position of at least the second reel for a further spin of the remaining reels.

17. A method in accordance with claim 11, further comprising:

determining that a pre-defined number of the designated symbol is displayed on any of the other of the plurality of reels after at least the second spin; and awarding a prize for the wagering game based at least in part on the determining.

18. A method in accordance with claim 11, further comprising:

determining less than a pre-defined number of the designated symbol is displayed on any of the other of the plurality of reels after at least the second spin; and terminating the wagering game, based at least in part on the determining, until an additional wager is made.

19. A gaming system comprising:

a gaming machine comprising:

a display device configured to display a plurality of symbol positions representing a plurality of reels, each symbol position presenting a symbol thereon for play of a wagering game;

an accepting device configured to accept an item associated with a monetary value, the monetary value establishing a credit balance, the credit balance being increasable and decreasable based at least on wagering activity;

a cashout device configured to receive an input to cause an initiation of a payout associated with the credit balance; and a gaming server comprising:

a non-transitory memory device storing computer-executable instructions thereon;

a random number generator; and a processor coupled to the non-transitory memory device and configured to execute the computer-executable instructions to:

receive, from the gaming machine, a wager amount placed for play of the wagering game, the wager amount decreasing the credit balance, the wagering game including the plurality of reels;

populate a first set of the plurality of symbol positions on each of the plurality of reels with a plurality of pre-determined symbols;

select a designated symbol;

populate a second set of the plurality of symbol positions on each of the plurality of reels with the designated symbol;

simulate and display a first spin of the plurality of reels using the random number generator and the display device of the gaming machine;

identify, after the first spin, that a first reel of the plurality of reels displays at least two of the designated symbols;

lock at least one symbol position of the first reel for at least a second spin of remaining reels of the plurality of reels, by the display device of the gaming machine, only when the first reel displays the at least two of the designated symbols; and detect the input to cause the initiation of the payout, via the cashout device.

20. A gaming system in accordance with claim 19, wherein the designated symbol is selected from a plurality of designated symbols.

21. A gaming system in accordance with claim 20, wherein each of the plurality of designated symbols have different weighted values.

22. A gaming system in accordance with claim 19, wherein at least the second spin of the remaining reels is without an additional wager from the gaming machine.

23. A gaming system in accordance with claim 19, wherein the at least two of the designated symbol are populated in consecutive order on at least one of the plurality of reels.

24. A gaming system in accordance with claim 19, wherein the processor is further programmed to:

after at least the second spin, determine that at least a second reel displays at least one of the generated symbols; and lock at least one position of at least the second reel for a further spin.

25. A gaming system in accordance with claim 19, wherein the processor is further programmed to:

determine that a pre-defined number of the designated symbols is displayed on any of the other of the plurality of reels after at least the second spin; and award a prize based at least in part on the determining.

26. A gaming system in accordance with claim 25, further comprising an additional display; and wherein the processor is further programmed to take a copy of each designated symbol that is presented on the display and present the copy on the additional display.

27. A gaming system in accordance with claim 26, wherein the additional display includes a number of symbol positions equal to the number of symbol positions on the display.

28. A gaming system in accordance with claim 19, wherein the processor is further programmed to:

determine that less than a pre-defined number of the designated symbol is displayed on all of the other of the plurality of reels after at least the second spin; and terminate any further generations of symbols on the plurality of reels, based at least in part on the determining, until an additional wager is received.

* * * * *